United States Patent [19]

Ogata et al.

[11] Patent Number: 4,567,496

[45] Date of Patent: Jan. 28, 1986

[54] PRESSURE-SENSITIVE RECORDING SHEETS

[75] Inventors: Yasuhiro Ogata; Masakazu Maekawa, both of Shizuoka, Japan

[73] Assignee: Fuji Photo Film Co., Ltd., Kanagawa, Japan

[21] Appl. No.: 505,510

[22] Filed: Jun. 17, 1983

[30] Foreign Application Priority Data

Jun. 18, 1982 [JP] Japan ..... 57-105161

[51] Int. Cl.[4] ..... B41M 5/1; B41M 5/22

[52] U.S. Cl. ..... 346/200; 162/76; 346/226; 427/150; 427/151; 428/537.5; 428/537.7

[58] Field of Search ..... 162/76; 282/27.5; 427/150, 151; 428/320.4–320.8, 411, 537, 913, 488, 537.5, 537.7; 346/200, 226

[56] References Cited

U.S. PATENT DOCUMENTS 3,296,065 1/1967 O'Brien et al. ..... 162/76

FOREIGN PATENT DOCUMENTS 0113592 9/1980 Japan ..... 346/226

*Primary Examiner*—Bruce H. Hess

*Attorney, Agent, or Firm*—Sughrue, Mion, Zinn, Macpeak & Seas

[57] ABSTRACT

A pressure-sensitive recording sheet is described. The sheet is comprised of a paper substrate which is treated with succinic acid derivatives having an alkenyl group or alkyl group containing from 4 to 18 carbon atoms, or salts thereof. This pressure-sensitive recording sheet is greatly reduced in the formation of fog which occurs in printing the sheet. Thus, it is very useful as no carbon paper.

12 Claims, No Drawings

PRESSURE-SENSITIVE RECORDING SHEETS

FIELD OF THE INVENTION

The present invention relates to pressure-sensitive recording sheets. More particularly, the present invention relates to pressure-sensitive recording sheets in which succinic acid derivatives containing an alkenyl or alkyl group, or salts thereof are used as internal sizing agents for the substrates of the sheets.

BACKGROUND OF THE INVENTION

Pressure-sensitive recording sheets utilizing the color forming reaction of electron donating color formers and electron accepting color developers are widely used as pressure-sensitive copying paper and do not require the use of carbon paper. Such pressure-sensitive recording sheets are described in, for example, U.S. Pat. Nos. 2,711,375, 2,712,507, 2,730,456, 2,730,457, and 3,617,334, and Japanese Patent Publication Nos. 18317/63, 1178/72, and 20972/72.

The most typical pressure-sensitive recording sheet is as follows:

An electron donating color former is dissolved in a suitable solvent, microencapsulated, and coated on a substrate of the sheets to produce an "upper sheet". Further, an electron accepting color developer is coated on a substrate of the sheets to produce a "lower sheet". Moreover, the above-prepared microcapsules are coated on one surface of a substrate of the sheets, and the color developer on the other surface to produce an "intermediate sheet". The upper sheet is superposed on the lower sheet in such a manner that the coated surfaces face each other, or alternatively, when it is desired to produce a number of copies, one intermediate sheet or a plurality of intermediate sheets are interposed between the upper and lower sheets. On application of pressure on the above-superposed sheets, i.e., a pressure-sensitive copying paper, by typing or writing, the microcapsules existing at pressure-applied areas are broken, allowing the color former contained therein to go out and move to the color developer layer. Thus, the color former reacts with the color developer, producing a color image pattern.

These pressure-sensitive recording sheets are widely used, for example, as chits or printing papers for a computer, and their usefulness is very high. Thus, various improvements in respect of quality have been increasingly demanded to be added to the pressure-sensitive recording sheets.

In recent years, when printing with a pressure-sensitive sensitive recording sheet or pressure-sensitive copying paper, not only the color developer-coated surface, but also the microcapsule-coated surface is often printed on. In this case, problems arise, particularly when the intermediate sheet is printed on; i.e., when the microcapsule-coated surface or the color developer-coated surface is printed on, the microcapsules are broken by application of pressure. As a result of this pressure the oil contained in the microcapsules comes out and permeates the base paper, and finally reaches the color developer-coated surface at the opposite side, forming a color and causing the so-called fog. In particular, when the metal salts of aromatic carboxylic acids are used as color developers, the phenomenon of fog easily occurs because of their high color-forming properties.

In order to eliminate the problem of fog, various methods have been developed. For example, in one method pressure-protecting agents, such as starch particles, are added to the microcapsule layer, in another method the size of microcapsules is decreased, in still another method the amount of a binder added is increased, and in yet another method the amount of the color former oil being added is decreased. Although these methods are now in commercial use they are somewhat undesirably in that they reduce the color density of the pressure-sensitive recording sheet.

In addition, a method of sizing the surface of the base paper using water-soluble polymers, such as a starch solution, polyvinyl alcohol (PVA), modified PVA, sodium alginate, gelatin, carboxymethyl cellulose (CMC), hydroxyethyl cellulose (HEC), and styrene-butadiene rubber (SBR), is in commercial use. In accordance with this method, however, no sufficient effect can be obtained unless the amount of the water-soluble polymer being used is increased. This is disadvantageous from a viewpoint of cost, and furthermore, reduces the color-forming properties.

Moreover, a method is known which comprises treating a base paper with specific fluoro compounds, such as a chromium complex salt of perfluoromonocarboxylic acid (Japanese Patent Application (OPI) No. 98913/73 (the term "OPI" as used herein means a "published unexamined Japanese patent application")) and perfluoroalkylsulfonamides (Japanese Patent Application (OPI) No. 125019/77) to make it oil-resistant. This method, however, seriously increases the cost of the base paper and, therefore, some difficulty is encountered in the industrial practice of the method.

SUMMARY OF THE INVENTION

An object of the invention is to provide a no-carbon intermediate paper which is reduced in the formation of printing fog.

Another object of the invention is to provide a no-carbon paper having excellent copying properties.

Another object of the invention is to provide a no-carbon paper which is inexpensive.

Another object of the invention is to provide a no-carbon intermediate paper in which the formation of printing fog is reduced even when metal salts of aromatic carboxylic acid are used as color developers.

It has been found that the objects can be attained by incorporating succinic acid derivatives having an alkenyl or alkyl group containing from 4 to 18 carbon atoms, or a salt thereof into the interior of a paper substrate as paper support base for a pressure-sensitive recording sheet.

The present invention relates to a pressure-sensitive recording sheet comprising a paper substrate, characterized in that the paper substrate contains succinic acid derivatives having an alkenyl or alkyl group containing from 4 to 18 carbon atoms, or a salt thereof in the interior thereof.

DETAILED DESCRIPTION OF THE INVENTION

Paper sizing agents as used herein are succinic acid derivatives having an alkenyl or alkyl group containing from 4 to 18 carbon atoms, and salts thereof. These succinic acid compounds and salts thereof are described in, for example, Japanese Patent Application (OPI) No. 25102/77.

Of succinic acid derivatives having an alkenyl or alkyl group, those compounds in which the number of carbon atoms in the alkenyl or alkyl group is from 4 to 18 are effective in sizing the paper substrate. The number of carbon atoms contained in the alkenyl or alkyl group is preferably from 8 to 14 and more preferably 10 to 12.

The sizing agent as used herein may be a mixture of succinic derivatives having different carbon chains. Even in this case, a mixture in which the average number of carbon atoms in the carbon chains is from 8 to 14 is preferred.

Salts of alkenyl- or alkyl-succinic acid include sodium, potassium, calcium, and low molecular organic amine salts, preferably sodium salts and potassium salts.

Alkenylsuccinic acid is prepared by addition-reacting α-olefin containing from 4 to 18 carbon atoms and maleic anhydride by the usual procedure to form alkenylsuccinic anhydride and, thereafter, hydrolyzing the alkenylsuccinic anhydride. As a sizing agent, a 1:1 or 1:2 (molar ratio) adduct of α-olefin and maleic anhydride is used.

Alkylsuccinic acid is prepared by hydrogenating alkenylsuccinic acid.

When the sizing agent is a free acid, or a salt of the acid and a metal having a valency of at least 2, it is often in an emulsion form. On the other hand, when the sizing agent is a salt of the acid and a univalent metal or organic amine, it is in an aqueous solution form.

The sizing agent exhibits the sizing effect even if it is used by the usual procedure, i.e., it is added to a pulp slurry and fixed to the pulp with a fixer, such as alumina sulfate. It is also preferred to use the sizing agent in combination with polyacrylamide, particularly carboxy-modified polyacrylamide.

Moreover, the sizing agent may be used in combination with internal additives which are generally used in paper making. These internal additives include fillers, e.g., clay, talc, and titanium oxide, dry paper strength-enhancing agents, e.g., starch, polyvinyl alcohol, and carboxymethyl cellulose, wet paper strength-enhancing agents, e.g., a melamine resin, a urea resin, and an epoxided polyamide resin, dye and pigment to control color tone, and fluorecent dye to improve whiteness. These additives may be used alone or in combination with each other in any suitable ratio. With regard to the order in which the sizing agent and other additives are added, it is determined so that the sizing effect can be obtained most effectively.

In connection with pulp, as a matter of course, all of the wood pulps (LBKP, NBKP, LBSP, NBSP, etc.) and the general plant fiber pulps, such as straw and esparto, can be used. These pulps may be partially replaced by synthetic pulp.

The paper substrate as a paper support base produced so as to meet the above-described requirements may be subjected to a surface sizing treatment using starch, PVA, gelatin, SBR, etc.

The term "microcapsule" as used herein refers to a small capsule having a mean particle diameter of from 1 to 20μ, which comprises an oily liquid with a basic, colorless color former dissolved therein, which is the contents of the microcapsule, and a wall material covering the oily liquid contents, said material being made of a polymeric substance which is insoluble in any of water and the oily liquid. As the wall material, a combination of polycation and polyanion, such as gelatin and gum arabic, a combination of polycondensation products, e.g., polyisocyanate-polyamine, polyisocyanate-polyol, urea-formaldehyde, and melamin-formaldehyde, and so on can be used.

Such microcapsules can be produced in any suitable manner, e.g., by a method of phase-separation from an aqueous solution (see, for example, U.S. Pat. No. 2,800,457 and 2,800,458, and Japanese Patent Publication Nos. 16166/72 and 32755/79), an external polymerization method (see, for example, Japanese Patent Publication No. 12518/63, Japanese Patent Application (OPI) Nos. 42380/72, 8780/75, 9079/76, 66878/77, 84881/78, 84882/78, and 84883/78, and Japanese Patent Application No. 126968/79), an interfacial polymerization method (see, for example, Japanese Patent Publication Nos. 19574/63, 446/67, 771/67, 2882/67, 2883/67, 8693/67, 9654/67, and 11344/67, and British Pat. Nos. 950,443 and 1,046,409), a method of polymerizing wall material in oil droplets (see, for example, Japanese Patent Publication Nos. 9168/61 and 45133/74), or a melt dispersion cooling method (see, for example, British Pat. Nos. 952,807 and 965,074).

The term "color former" as used herein refers to a compound which forms color on donating an electron or on accepting a proton, such as an acid. Although the color former as used herein is not critical, there are usually used those compounds which are almost colorless, and have a partial skelton, such as lactone, lactam, sultone, spiropyran, ester, and amide, which undergoes ring-opening or cleavage when the compounds come into contact with a color developer. Suitable examples are Crystal Violet Lactone, Benzoyl Leuco Methylene Blue, Marachite Green Lactone, Rhodamine B Lactam, 1,3,3-trimethyl-6′-ethyl-8′-butoxyindolinobenzospiropyran, and the like. The amount of color former used is preferably 0.01 to 0.5 g/m$^2$, more preferably 0.02 to 0.1 g/m$^2$.

The color former is dissolved in a suitable solvent and encapsulated.

As such solvents, natural and synthetic oils can be used alone or in combination with each other. Suitable examples of such oils include cotton seed oil, kerosine, paraffin, naphthenic oil, alkylated biphenyl, alkylated terphenyl, chlorinated paraffin, alkylated naphthalene, and diarylethane.

As binders, various water-soluble polymers, such as PVA, starch, gelatin, gum arabic, CMC, HEC, SBR, and polyacrylic acid, can be used.

Capsule-protecting agents which can be used are granular substances which are solid at ordinary temperature, for example, starch particles, polymer fine powder, microcapsules not containing a color former, talc, kaolin, and agalmatolite.

The color developer as used herein is of the type that accepts an electron or donates a proton, and is an adsorptive or reactive compound which forms color on coming into contact with the above-described color former. Suitable examples include clay materials, such as acid clay, bentonite, and kaolin, a phenol/formalin novolak resin, a metal-treated novolak resin, and the metal salt of aromatic carboxylic acid. The amount of color developer used is preferably 0.1 to 2 g/m$^2$.

The effect of the invention can be obtained most efficiently when such aromatic carboxylic acid metal salts are used as color developers. Aromatic carboxylic acids and metal salts thereof include aromatic carboxylic acids having a total number of carbon atoms of at least 15, preferably at least 19, e.g., 3,5-di(α-methylbenzyl)salicylic acid, 3-(α-methylbenzyl)-5-(α, α-dimethylbenzyl)salicylic acid, 3-(4'-α',α'-dimethylbenzyl)phenyl-5-(α,α-dimethylbenzyl)salicylic acid, 3,5-di-tert-butylsalicylic acid, 3,5-di-tert-octylsalicylic acid, 3-cyclohexyl-5-(α,α-dimethylbenzyl)salicylic acid, 3-phenyl-5-(α,α-dimethylbenzyl)salicylic acid, and 3,5-di(α,α-dimethylbenzyl)salicyclic acid, and multivalent metal salts thereof, e.g., zinc, aluminum, barium, tin, iron, calcium, and lead salts. Of these compounds, white or colorless metal salts are preferred, and zinc salts are particularly preferred.

The color developer solution may contain inorganic pigments, such as talc, high quality clay, aluminum hydroxide, calcium carbonate, kaolin, calcined kaolin, acid clay, diatomaceous earth, geolite, activated clay, zinc oxide, and magnesium oxide, and as binders, water-soluble polymers such as carboxy-modified styrene/-butadiene latex, PVA, starch, and HEC.

It is preferred that the color developer and inorganic pigment is ground to 8μ or less and finely dispersed by a suitable dispersing technique, e.g., by means of a sand mill, an attritor ball mill, and a horizontal sand mill (dyno mill).

The aromatic carboxylic acid metal salt may be dissolved in an organic solvent, such as alkylnaphthalene, diphenylalkane, diarylethane, hydrogenated terphenyl, chlorinated paraffin, paraffin, kerosine, and plant oil, emulsified or encapsulated, and thereafter, incorporated into the color developer coating solution.

These various additives, binders, antioxidants, smuge-preventing agents, and surfactants which are used in the color developer or color former, coating methods, and methods of using the ultimate recording sheets are well known as described in, for example, U.S. Pat. Nos. 2,711,375 and 3,625,736, British Pat. No. 1,232,347, Japanese Patent Application (OPI) Nos. 44012/75, 50112/75, 127718/75, and 30615/75, and U.S. Pat. Nos. 3,836,383 and 3,846,331.

The amount of the sizing agent of the invention being added is, based on the weight of pulp, appropriately from 0.01 to 10 wt %, preferably from 0.05 to 5 wt %, and more preferably from 0.1 to 2 wt %.

When the amount of the sizing agent being added is less than 0.01 wt %, the effect of increasing the oil resistance of the paper substrate, and the effect of preventing the coating solution from permeating the paper substrate cannot be obtained sufficiently. The addition of the sizing agent in an amount of more than 10 wt % is disadvantageous from a viewpoint of cost.

It is considered that the sizing agent of the invention provides the paper substrate with oil resistance since it has repellency against solvents, such as alkylated naphthalene, diarylethane, alkylated biphenyl, paraffin, and kerosine, which are contained in the capsule. That is, with the no-carbon intermediate paper prepared using the sizing agent of the invention, the permeation of the coating solution through the paper is reduced, the formation of printing fog is reduced since the oil resistance of the paper is high, and furthermore, since the permeation of the coating solution through the paper is reduced, there can be obtained a sufficient color density.

The present invention is described in detail with reference to the following examples and comparative examples. However, the scope of the invention is not limited to these example. All percents and parts are by weight. The coating amount is a dry weight.

A microcapsule solution and a color developer solution used in the examples and comparative examples were prepared as follows:

Preparation of Microcapsule Solution

In 100 parts of a 4.4% aqueous solution of partial sodium salt of polyvinylbenzenesulfonic acid (average molecular weight, 500,000) which was adjusted to pH 4 was emulsified and dispersed 100 parts of diisopropylnaphthalene with 2.5% CVL and 2% BLMB dissolved therein to prepare an o/w emulsion having an average particle diameter of 4.5μ.

Separately, 6 parts of melamine, 11 parts of a 37% aqueous solution of formaldehyde, and 83 parts of water were stirred while heating at 60° C. Thirty minutes later, an aqueous mixed solution of transparent melamine, formaldehyde, and a melamine-formaldehyde precondensate was obtained.

This aqueous mixed solution was added to the above-prepared emulsion. The resulting mixture was then adjusted to pH 6.0 with a 20% aqueous solution of acetic acid while stirring, raised in temperature to 65° C., and maintained at that temperature for 30 minutes to complete encapsulation.

To this solution were added 200 parts of a 20% aqueous solution of etherated starch, 47 parts of starch particles (average particle diameter, 40μ), and 10 parts of talc.

Subsequently, 32 parts of a 2% aqueous solution of sodium dioctylsulfosuccinate was added as a surfactant, and further, water was added to prepare a microcapsule solution in which the solids content was adjusted to 20%.

Preparation of Color Developer Solution

A mixture of 25 parts activated clay, 75 parts calcium carbonate, 10 parts zinc oxide, 10 parts zinc 3,5-di-α-methylbenzylsalicylate, and 1 part sodium hexametaphosphate was dispersed in 200 parts water by means of a Kedy mill. The resulting dispersion was further finely dispersed in a horizontal sand mill (Dyno mill manufactured by Willy A. Bachofin Co.) until the volume average particle diameter reached 3μ or less.

The thus-prepared dispersion was added with stirring to a mixed binder consisting of 125 parts of a 8% aqueous solution of polyvinyl alcohol (PVA-117 produced by Kuraray Co., Ltd.) and 10 parts (as solids) of carboxy-modified SBR (styrene-butadiene rubber) latex (SN-304 produced by Sumitomo Nogatck Co., Ltd.), and water was then added thereto to adjust the solids content to 20% by weight. There was thus obtained a coating solution.

Evaluation of Printing Fog (1) Practical Test

The color developer-coated surface of an intermediate sheet was printed on a letterpress printing machine, Model KSB (manufactured by Heiderberg Co., in West Germany) by a letterpress printing method. The thus-printed matters were piled on each other, and the printing fog formed in the color developer-coated surface was determined with the naked eye.

The printing speed was 3,000 sheets per hour.

The determination of fog formation is as follows:

A: Almost no fog formation is observed.

B: Fog is formed only slightly.

C: Fog is formed.

D: Fog is seriously formed.

From a practical viewpoint, A and B are desirable.

(2) Substitute Test

After a single intermediate sheet was allowed to stand in a dark place overnight under a load of 200 kg/cm$^2$, the density of fog (due to permeation color-formation) of the color developer-coated surface was measured by a spectrometer.

EXAMPLE 1

To a slurry of LBKP pulp which had been beaten to a freeness of 350 cc was added 0.5% (based on pulp) of n-decenylsuccinic acid, and 2% of alumina sulfate was then added thereto. Using the slurry, paper was made by the usual paper-making procedure. The thus-produced paper was subjected to a size press treatment in an amount (as solids) of 0.5 g/m$^2$ using an aqueous starch solution.

EXAMPLE 2

To a slurry of 7:3 mixed pulp of LBKP and NBKP which had been beaten to a freeness of 450 cc was added 0.2% (based on pulp) of sodium n-decylsuccinate, and 0.5% (based on pulp) of carboxy-modified polyacrylamide (degree of carboxy modification: 5 mol %; degree of polymerization: about 800,000) was added thereto. Then, 2% (based on pulp) of alumina sulfate was added. Using the resulting slurry, paper was produced by the usual paper making procedure.

COMPARATIVE EXAMPLE 1

Paper was produced in the same manner as in Example 1 except that the n-decylsuccinate acid was replaced by rosin and the alumina sulfate was added in a proportion (based on pulp) of 2%.

COMPARATIVE EXAMPLE 2

Paper was produced in the same manner as in Example 2 except that the sodium n-decylsuccinate was replaced by a rosin emulsion.

With each of the paper substrates produced in the above-described Examples and Comparative Examples, the above-prepared color developer solution was coated on the surface in an amount (as solids) of 4.0 g/m$^2$ by means of an air knife coater and, thereafter, the above-prepared microcapsule solution was coated on the back surface in an amount (as solids) of 4.5 g/m$^2$ by means of an air knife coater to produce a no-carbon intermediate paper.

Two no-carbon intermediate papers were superposed in such a manner that the microcapsule-coated surface and the color developer-coated surface faced each other. The letter m was closely typed on the superposed papers to cause color formation. Ten minutes later, the density of color was measured by a spectrometer. Also, the formation of printing fog was measured by the above-described method.

The results are shown in the table below.

| Run No. | Printing Fog: Practical Test | Printing Fog: Substitute Test | Density of Color formed by Typewriter |
|---|---|---|---|
| Example 1 | A | 0.08 | 0.38 |
| Example 2 | A | 0.07 | 0.37 |
| Comparative Example 1 | D | 0.45 | 0.30 |
| Comparative Example 2 | C | 0.35 | 0.30 |

It can be seen from the above results that with the no-carbon copying paper of the invention, the formation of printing fog, which is a serious problem for conventional intermediate papers, is greatly reduced, and there can be obtained a recording image having a high color density.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet comprising a paper substrate which contains therein a succinic acid derivative having an alkenyl or alkyl group, or a salt thereof, said group containing from 4 to 18 carbon atoms and a layer containing an electron-donating color former and/or an electron-accepting color developer, wherein the succinic acid derivative or salt thereof is present in an amount within the range of 0.01 to 10% based on the weight of the paper substrate and wherein said succinic acid derivative or salt thereof is added to a pulp slurry and fixed to the pulp with a fixer, whereafter said paper substrate is formed.

2. A pressure-sensitive recording sheet as claimed in claim 1, wherein the alkenyl or alkyl group contains 8 to 14 carbon atoms.

3. A pressure-sensitive recording sheet as claimed in claim 2, wherein the alkenyl or alkyl group contains 10–12 carbon atoms.

4. A pressure-sensitive recording sheet as claimed in claim 1, wherein the salt is a salt selected from the group consisting of sodium salts, potassium salts, calcium salts and low molecular organic amine salts.

5. A pressure-sensitive recording sheet as claimed in claim 1, wherein the succinic acid derivative or salt thereof is present in an amount within the range of 0.05 to 5 percent based on the weight of the base paper.

6. A pressure-sensitive recording sheet as claimed in claim 5, wherein the succinic acid derivative or salt thereof is present in an amount within the range of 0.1 to 2 percent based on the weight of the base paper.

7. A pressure-sensitive recording sheet as claimed in claim 1, wherein said fixer is alumina sulfate.

8. A pressure-sensitive recording sheet as claimed in claim 1, wherein said succinic acid derivative or salt thereof is used in combination with polyacrylamide.

9. A pressure-sensitive recording sheet as claimed in claim 8, wherein said polyacrylamide is carboxy-modified polyacrylamide.

10. A pressure-sensitive recording sheet as claimed in claim 1, wherein said color developer is an aromatic carboxylic acid metal salt.

11. A pressure-sensitive recording sheet as claimed in claim 10, wherein said aromatic carboxylic acid has a total number of carbon atoms of at least 15.

12. A pressure-sensitive recording sheet as claimed in claim 11, wherein said metal is selected from the group consisting of aluminum, barium, tin, iron, calcium and lead.

* * * * *